United States Patent [19]
Claycomb

[11] 4,454,598
[45] Jun. 12, 1984

[54] DRILLING ORIENTATION TOOL

[75] Inventor: Jack R. Claycomb, Houston, Tex.

[73] Assignee: Dresser Industries, Inc., Dallas, Tex.

[21] Appl. No.: 405,594

[22] Filed: Aug. 5, 1982

Related U.S. Application Data

[60] Division of Ser. No. 113,560, Jan. 1, 1980, which is a continuation-in-part of Ser. No. 890,368, Mar. 17, 1978, Pat. No. 4,184,545.

[51] Int. Cl.³ ..... G01V 1/40
[52] U.S. Cl. ..... 367/83; 175/48; 175/50
[58] Field of Search ..... 367/81, 83, 85; 175/45, 175/150, 48; 33/307

[56] References Cited

U.S. PATENT DOCUMENTS

| | | | |
|---|---|---|---|
| 2,700,131 | 1/1955 | Otis et al. | 367/83 |
| 2,755,432 | 7/1956 | Arps et al. | 367/83 |
| 2,759,143 | 8/1956 | Arps | 367/83 |
| 3,303,573 | 2/1968 | Alder et al. | 367/83 |
| 3,800,277 | 3/1974 | Patton et al. | 367/83 |
| 3,983,948 | 10/1976 | Jeter | 367/83 |
| 4,027,282 | 5/1977 | Jeter | 367/85 |
| 4,078,620 | 3/1978 | Westlake | 367/83 |
| 4,100,528 | 7/1978 | Bernard et al. | 367/83 |

*Primary Examiner*—Nelson Moskowitz
*Attorney, Agent, or Firm*—Gunn, Lee & Jackson

[57] ABSTRACT

In the preferred and illustrated embodiment of the present apparatus, a drilling orientation tool is disclosed utilizing a mud pressure charging system where the pressure charge is converted into hydraulic oil pressure. The hydraulic oil flow is supplied to a four-way, three-position, solenoid operated valve having a closed center position, the valve forming a control signal delivered to an adjustable constriction in the mud flow path through the tool. Variables are encoded dependent on opening and closing of the constriction. Consecutive variables are transmitted in the form of fine and coarse measures. The electrically operated solenoid valve thus encodes two or more variables for transmission to the surface by detecting mud pressure variations in the mud flow line at the surface.

13 Claims, 8 Drawing Figures

DRILLING ORIENTATION TOOL

RELATED APPLICATIONS

This application is a divisional application of copending application Ser. No. 113,560 filed Jan. 1, 1980, now U.S. Pat. No. 4,371,958, issued Feb. 1, 1983, which is a continuation-in-part application of Ser. No. 890,368 filed Mar. 17, 1978 now U.S. Pat. No. 4,184,545, issued Jan. 22, 1980.

BACKGROUND OF THE DISCLOSURE

This apparatus is an alternate approach to the structure shown in the above referenced patent which is drawn to a mud flow powered system which utilizes hydraulic oil, pumps and other apparatus more aptly shown in the patent to form output signals which encode the variables of interest. By contrast, this apparatus is directed to a hydraulic system utilizing an electrically powered solenoid valve output arrangement. To this end, the apparatus is triggered into operation by termination of drilling activities so that certain variables can be encoded and transmitted to the surface. As an example, three variables of interest in a downhole situation include heading, inclination and orientation. Inclination is the deviation of the tool at its downhole location compared with a vertical direction determined by a plumb bob. Heading refers to the direction of the hole in azimuth using north as a reference. Orientation refers to relative rotation of the tool with respect to a selected side of the tool. Inclination typically has a range of 0–90.0 degrees maximum, while heading and orientation both have a maximum range of 360.0 degrees.

These variables are measured and encoded. The encoding procedure utilizes an adjustable constriction in the tool to choke or constrain the back pressure on the mud flow path through the tool. This pressure variation can be sensed at the surface by detecting pressure variations in the mud flow line as mud is delivered to the drill string.

With the foregoing in mind, this apparatus is summarized briefly as a measuring while drilling tool which is installed in the drill string. It is compatible with a string of drill collars and is preferably located in the string of drill collars near the drill bit. To this end, it includes conventional pin and box connections and an axial passage therethrough for delivery of drilling mud. The apparatus utilizes a nose plug installed in the mud flow path which responds to pressure of the drilling mud. It is forced downwardly in response to pump pressure on the mud, and its downward movement charges a hydraulic system. The hydraulic system utilizes a three-position, four-way valve which is solenoid operated to control a constriction in the mud flow path. The constriction is made severe or is opened to the maximum capacity to thereby form pressure surges. The pressure surges have a variable duration to encode the signal of interest. The variable of interest is thus formed into an electrical signal for operation of a solenoid.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

DETAILED DESCRIPTION OF THE PREFERRED EMBODIMENT

Attention is first directed to FIG. 1A where the tool will be described proceeding from the top to the bottom. The description will focus primarily on FIG. 1A and thereafter proceed to FIG. 1B and the other components. Inasmuch as the description will proceed from the top of the tool, in certain instances, it will be appropriate to refer to operation of parts of the tool located lower in the tool which had not been described at that juncture. In any case, the description will presume that the tool is installed in a drill string typically including several thousand feet of drill pipe. The drill string is connected to a mud flow line which delivers mud to the drill string from the well head as drilling proceeds. The measuring while drilling tool is located just above the drill bit. The drill bit is guided, and its movement or path is directed by a number of stiff drill collars just above the drill bit. The present invention is installed among or below the drill collars.

Figure 1A:
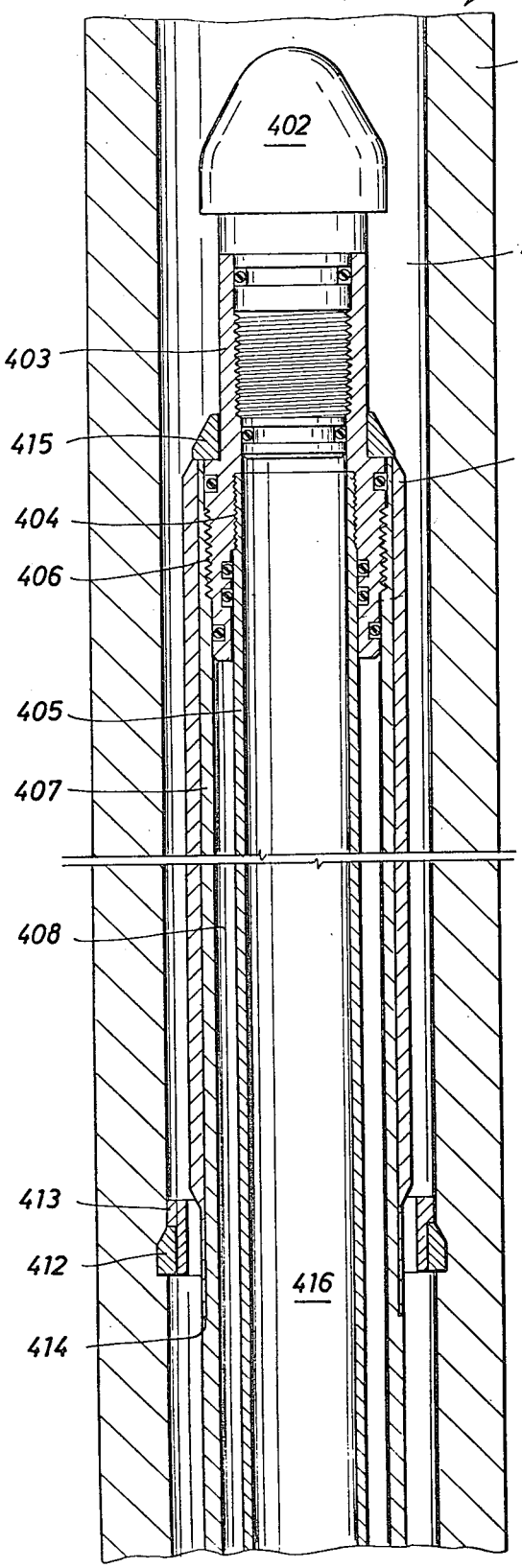
FIG. 1 is a view comprising parts 1A through part 1G, the several views collectively describing the measuring while drilling tool of the present apparatus in detail from top to bottom.

In the drawings, FIG. 1A discloses this apparatus primarily in sectional view wherein the tool of the present invention is identified by the numeral 400. The tool 400 is a measuring while drilling tool having pin and box connections (omitted for the sake of brevity) enabling it to be connected in a drill string. FIG. 1A discloses a thickened outer tubular shell or body 401 of substantial wall thickness to provide adequate strength and to add weight to the drill bit so that the tool can function somewhat in the fashion of a drill collar. Drill collars are generally deemed to be drill pipe with extra thick walls to impart weight and stiffness to the drill bit so the hole is maintained true or straight. Notwithstanding the incorporation of drill collars, many wells drift or deviate from a true vertical direction. The present invention will be described as an apparatus which measures the impact of this drifting. The drift or deviation is encoded by measuring three variables. The variables are inclination from the vertical, heading, referring to the azimuthal direction of the deviated hole, and orientation of the tool, referring to a selected side of the tool. As will be appreciated, all three variables require some reference.

Mud is delivered through the drill string and flows through the heavy walled tool 400. The flow path is interrupted by a nose plug 402 which is a relatively broad and somewhat streamlined, bullet-shaped plug positioned in the mud flow path to be pushed downwardly in FIG. 1A by the mud flow. The nose plug 402 is threadedly joined to a hollow, upstanding, internally threaded sub 403. The sub 403 is internally threaded at the upper end to receive the nose plug 402 and is internally threaded at the lower end 404 to receive a small, internal, tubular sleeve 405. The sleeve 405 is a thin wall member concentric of the thick outer wall 401. The sub 403 includes three sets of threads. There is additionally a lower outer thread 406 which enables the sub 403 to thread to a tubular member 407 concentric about the tubular sleeve 405. Both the tubular member 407 and the tubular sleeve 405 are threaded to the sub 403, the sub holding the upper ends in a fixed relationship and further providing concentric positioning of the two. The sub wall thickness defines an annular space 408 which is below the sub 403 and between the two tubular sleeves 405 and 407. This is an annular cavity which is sealed at the upper end by several seals at the threads 404 and 406 to prevent leakage from the annular space 408. The annular space 408 is adapted to receive oil in it at increased pressure.

The numeral 409 identifies a third or outer sleeve fixed to the tubular sleeve 407, and the two move together. The sleeve 409 fills a substantial portion of the cross-sectional area through the tool to thereby define a mud annulus 410. The annulus 410 communicates with the drill string above and eventually to the drill bit below to deliver drilling mud. The annular space 410 extends along the full length of the tool 400 shown in the several portions of FIG. 1. The mud flows in the annular space except at the lower portions of the tool to be described below.

A restricter ring 412 is positioned in an internal groove cut in the thick outer wall 401. The restricter ring 412 is locked in position and attached in some suitable manner. The ring 412 supports a second restricter ring 413 which extends radially inwardly to thereby limit flow past the restricter ring. The use of a multisegmented ring enables relatively easy assembly inasmuch as the ring 412 can be provided in pieces or segments, seated in the groove and the ring 413 thereafter forced down through the top of the tool into the illustrated location. The restricter ring assembly shown in FIG. 1A cooperates with the larger sleeve 409. As will be observed, the nose plug 402 is in the up position. When it is forced down slightly, flow is restricted severely. This increases the pressure drop across the restriction. Inevitably, this applies more force to the nose plug 402 and forces it down. It moves down until it moves past the restricter ring assembly shown in FIG. 1A. This downward travel is useful for reasons to be described below. Downward travel of the nose plug 402 is accompanied by movement of the tubular sleeves 405, 407 and 409. When this action occurs, the annular space 408 is reduced in capacity or volume.

A shoulder 414 is incorporated to receive the lower tail end of the sleeve 409. The sleeve 409 is thus an external enlargement which fully encircles the upper end of the telescoping assembly shown in FIG. 1A to controllably alter the mud flow constriction at the restricter ring, thereby altering the force applied to the nose plug 402. A lock ring 415 is attached around the sub 403 at the upper end. The lock ring 415, in conjunction with the shoulder 414, secures the sleeve 409 around the upper end of the telescoping assembly. The ring 415 is a carbide ring to reduce wear from mud flow.

The tubular member 405 is hollow on the interior and defines a closed or sealed central cavity 416 which is a storage chamber to be described. The cavity 416 is not communicated with the annular space 408.

Figure 1B:
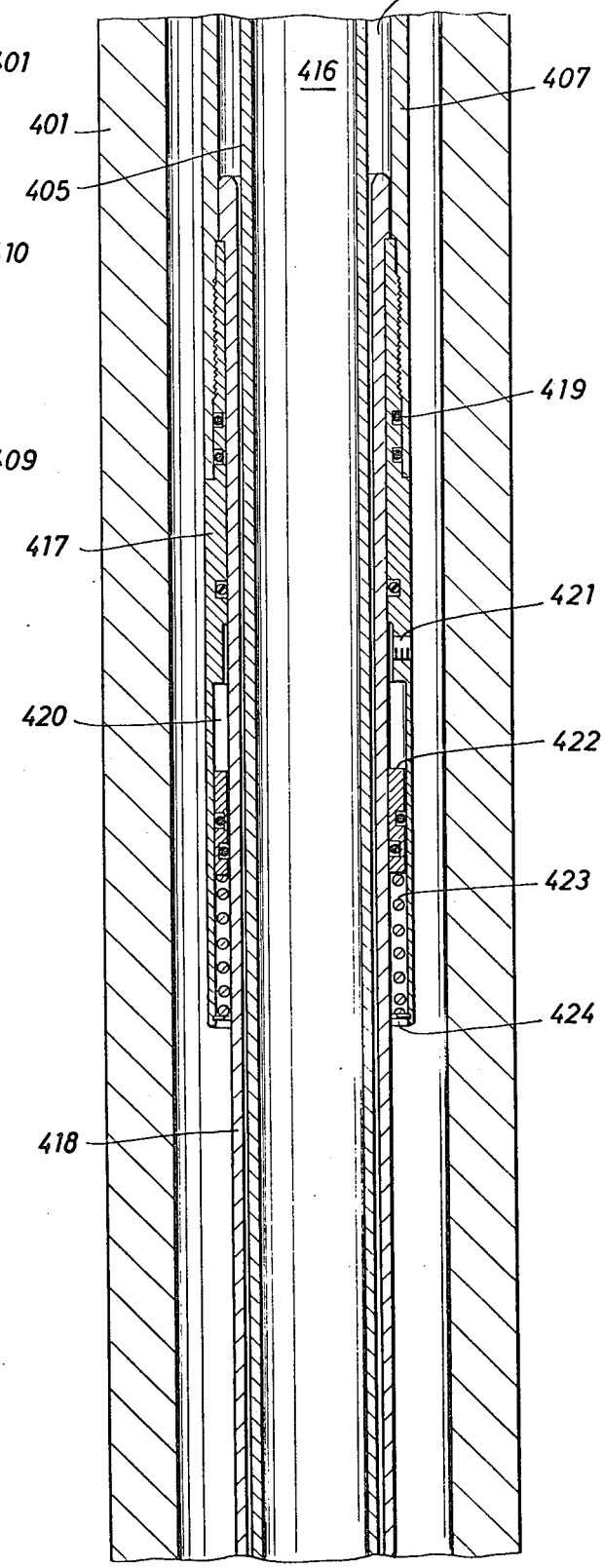

Going now to FIG. 1B, it will be observed that the heavy or thick outer wall 401 is continued along the length of the tool. The mud flow path 410 is likewise continued. The tubular sleeve 407 is likewise continued from FIG. 1A. The smaller and internal tubular sleeve 405 is additionally continued. This further continues the annular cavity 408, whose function will be understood hereinafter.

The numeral 417 identifies a hollow sub which is a manufacturing expedient in that it interrupts some of the tubular members. It is easier to fabricate short tubular members in comparison with long tubular members. Moreover, the sub 417 supports and aligns a second outer tubular member 418. So to speak, the outer tubular member 407 shown in FIG. 1A is terminated and telescopes relative to the second tubular member 418 at the hollow sub 417. Through the use of a seal assembly 419 and suitable threads, the outer tubular member 407 is joined to the hollow sub 417. The O-ring assembly prevents leakage from the annular space 408. The annular space 408 receives oil which is, from time to time, placed under high pressure, and the space 408 is thus continued in FIG. 1B. The space is defined as a high pressure oil chamber or cavity.

The numeral 420 defines an annular cavity shown in FIG. 1B at the hollow sub 417. The cavity 420 receives lubricating oil or grease of a fairly thick consistency. Because sliding movement occurs, it is preferable to provide a sealing and lubricating grease. The grease is stored in the annular cavity 420 after admission through a port 421 formed in the hollow sub 417. A lubricating ring 422 terminates the bottom part of the annular cavity 420. The lubricating ring 422 is forced upwardly to pressurize the lubricant, this being provided by a spring 423 received in an undercut annular opening in the hollow sub 417. This undercut annular cavity receives the lubricating ring 422 and the spring 423 therebelow. The spring is, in turn, held in position by a lock ring 424 secured in an internally cut groove for the lock ring.

Lubricant in the hollow sub 417 is applied against the outer face of the second outer tubular member 418. It prevents the intrusion of drilling mud past the hollow sub 417.

Figure 1C:
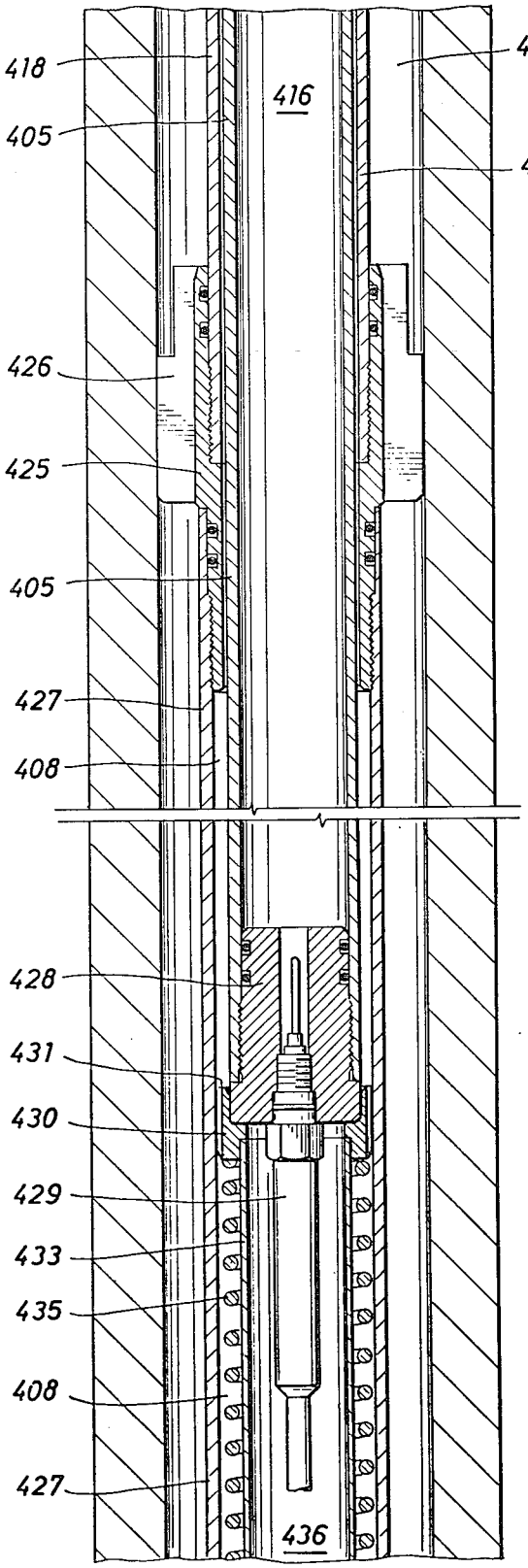

Going now to FIG. 1C, the pair of concentric tubular members 405 and 418 are continued in this view, and the annular space 408 is likewise continued between them. Making transition of the views more complete, the annular mud flow space 410 is likewise continued. The central cavity 416 is also continued. It will be recalled that the annular space 408 has oil in it sometimes maintained at a relatively high pressure, and this is referred to as the high pressure side of the hydraulic system.

A central sub 425 is shown in FIG. 1C aligned by a set of vanes 426 which extend outwardly to position the sub 425 relative to the thick outer wall which surrounds the mud flow space 410. The vanes 426 do not obstruct the mud flow, and they are incorporated at three or more locations to center the concentric equipment within the mud flow space 410.

The numeral 427 identifies an outer tubular member which is threaded to the central sub 425. The sub 425 serves as a continuation or bridging component and, thus, joins the second outer tubular member 418 to the third outer tubular member 427. They both jointly continue the annular cavity 408 for high pressure oil. FIG. 1C further discloses that the inner tubular member 405 is concentric of the center sub 425. The annular cavity 408 extends therebelow to a solid plug body 428 which threads to the interior of the internal tubular sleeve 405. The plug 428 completely plugs and thereby terminates the central cavity 416. The plug 428 threads against the bottom or end shoulder. Moreover, the plug 428 threadedly supports an electrical plug and socket fixture identified at 429. The central cavity above the plug 428 is a space to receive a tubular battery pack not shown. Preferably, the battery pack 9. The central cavity above the plug 428 is a space to receive a tubular battery pack not shown. Preferably, the battery pack fits in the space loosely and is connected through the plug 428 by means of the electrical plug and socket fixture 429.

The plug 428 is joined to the smaller or internal tubular sleeve 405 and is concentrically located within the third outer tubular member 427. The flow path including the annular space 408 is continued past the plug 428. The plug 428 incorporates a bottom ring 430 which includes a downwardly facing shoulder. The ring 430 is centered by means of vanes 431 which extend into the annular space 408. This continues the high pressure flow path.

The numeral 433 identifies a second inner tubular sleeve which abuts against the ring 430. The ring 430 is an alignment mechanism and has an internal shoulder facing downwardly which receives the second inner tubular member 433. The second inner tubular member 433 thus functions as an extension of the first tubular member 405 shown in the upper part of FIG. 1C. The two tubular members thus extend and continue the annular space 408.

The ring 430 includes a downwardly facing shoulder which receives a coil spring 435. The coil spring 435 forces the tubular members upwardly inasmuch as it bears against the ring 430. The second inner tubular member 433 defines an internal cavity 436 shown partly in FIG. 1C and also in FIG. 1D. The cavity 436 includes adequate space for receiving an electrical socket 437 which enables electrical communication through wiring (partly omitted) from the battery pack positioned above the plug 428. The socket 437 is joined to a sealed electronic housing 438 shown in FIG. 1D. This housing stores the electronic equipment of interest to the apparatus.

Figure 1D:
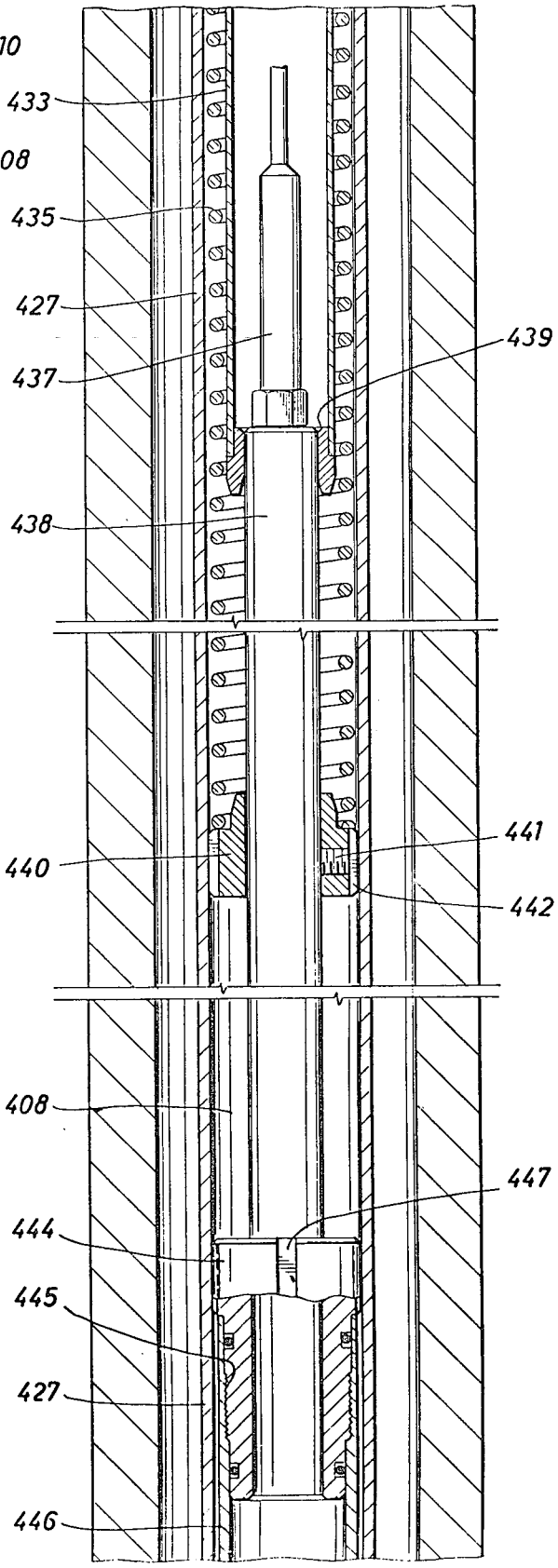

Continuing on with the description, FIG. 1D shows a transition ring 439 about the electronic housing. The ring 439 includes an upwardly facing shoulder which seats against the second inner tubular sleeve 433. A lock ring 440 is positioned about the electronic housing 438 and is lower in the body. The lock ring 440 includes an upwardly facing shoulder for receiving the coil spring 435 which bears against the lock ring 440. The lock ring 440 is held in place by means of a set screw 441 and is aligned by a set of vanes 442. The vanes 442 cooperate with the third outer tubular member 427 to align the parts for concentric telescoping movement, and they continue the flow path for oil under pressure.

As will be observed in FIG. 1D, the coil spring 435 extends a significant portion of the length of the tool. Moreover, it applies a spring created force which acts beneath the nose plug 402 shown in FIG. 1A to force the plug upwardly when permitted.

FIG. 1D incorporates a central sub 444 affixed to the electronic housing 438 and centered within the third outer tubular member 427. The sub 444 is held in the centered position by a set of vanes 447. The sub 444 includes externally located threads 445 around its lower portions which join to a third inner tubular member 446. The inner tubular member 446 is an extension of other tubular members such as the second inner tubular member 433. As will be understood, this is continued in FIG. 1E where the top portion of that view shows the annular mud space 410, the third outer tubular member 427, the third inner tubular member 446 and the continued annular space 408 between the tubular members. The third inner tubular member 446 thus defines additional inner cavity space used to receive electrical wiring and an electronics housing.

Figure 1E:
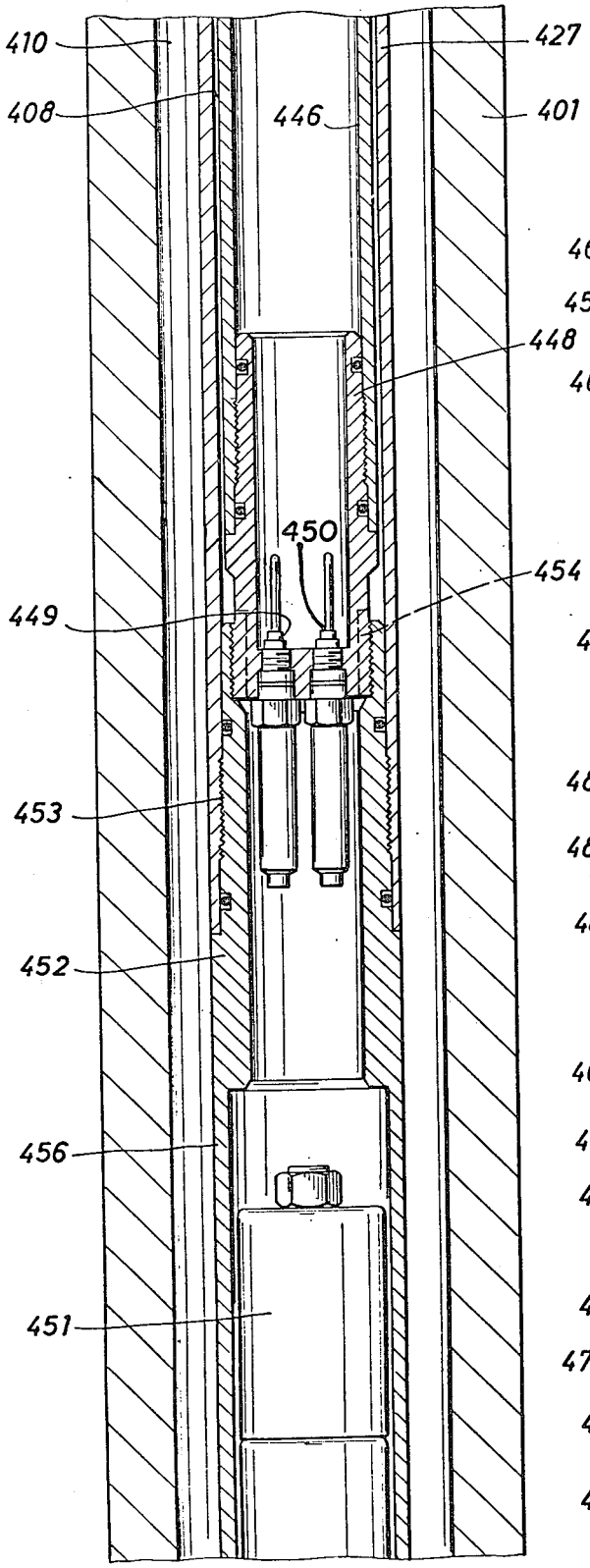

In FIG. 1E, the numeral 448 identifies a sealed sub supporting a set of internally located electrical feed posts 449 which connect upwardly through coiled conductors to the electronic housing 438. Seals are included so that leakage past the electric feed posts 449 is prevented. The electric feed posts 449 enable electrical connection to a solenoid housing 451. Again, the wiring is omitted between the housing 451 and the electric feed posts 449. The sealed sub 448 is threadedly joined to a fitting 452 by means of threads at 453. The two members 448 and 452 thread together in the illustrated manner, and suitable seals are, of course, included. The threaded connection just referenced interrupts the annular cavity or flow space 408. This flow space is continued by means of slots 454 which are cut at the threads 453. These slots extend the annular flow path. At this juncture, the slots enable the flow path to switch from an annular location shown at the top of FIG. 1E through the interior of the fitting 452. On the interior, the flow path is thus continued. Moreover, the sub 448 is threaded to the third outer tubular member 427 via the fitting 452. At this juncture, a crossover has been achieved whereby an annulus in the upper portions of FIG. 1E are converted to a centralized high pressure oil flow path within a singular tubular member at 452.

The fitting 452 has a relatively thick wall at the upper end to accommodate construction of threads, grooves for seals and the like. A skirt 456 is integrally constructed with the fitting 452 and extends therebelow. It encircles the solenoid housing 451 with sufficient space to extend the high pressure flow path below.

Figure 1F:
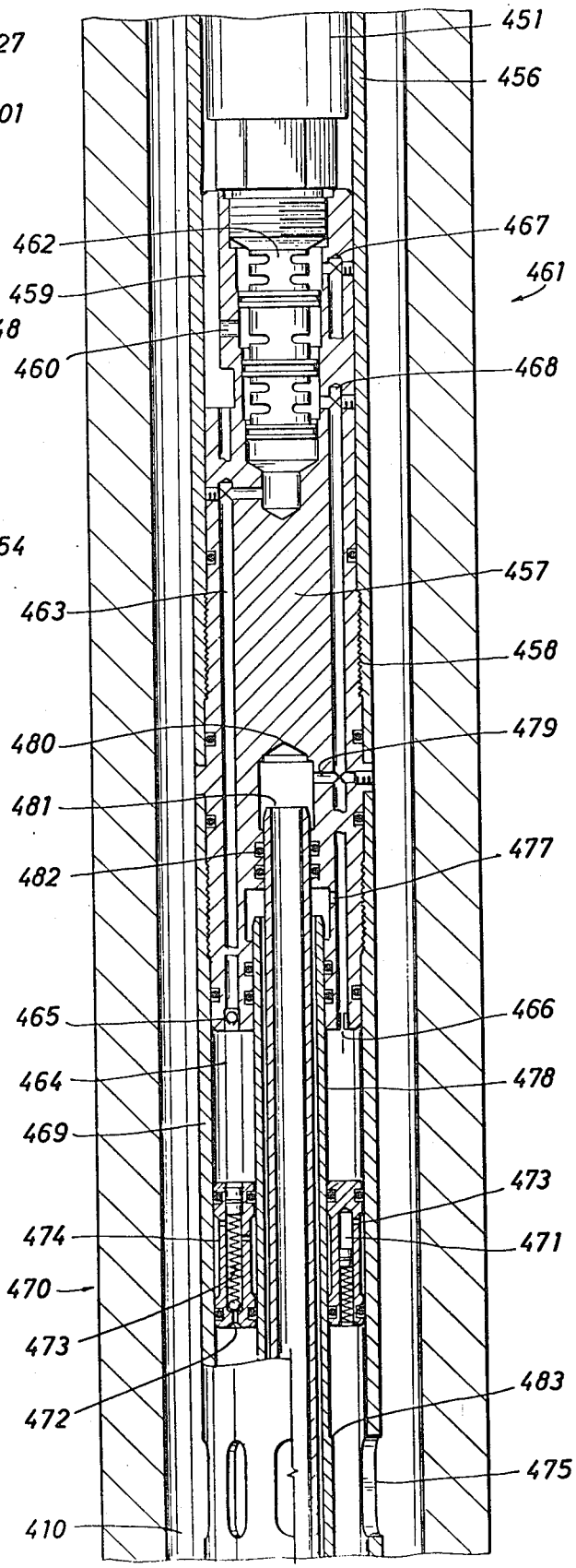

FIG. 1F discloses how the skirt extends downwardly, still enclosing the solenoid housing 451 and capturing the valve body 457 shown in FIG. 1F. The valve body is a part of the valve assembly included within the body and which is operated by the solenoid within the solenoid housing 451.

The valve body 457 is threaded at 458 to the skirt 456 which surrounds it. The top portion of FIG. 1F discloses the continued passage 459 which, at this juncture, is converted from an annular flow space at the very top of FIG. 1F into a drilled passage. It communicates by means of a lateral port 460 to the valve to be described.

Electrical connectors 449, having the preferred form of feedthroughs, connect by means of conductors (not shown) with the housing 451 for a solenoid. The housing 451 is received within the skirt 456 which surrounds the solenoid housing 451, there being a small gap on the exterior to permit hydraulic fluid to flow past the solenoid housing.

The skirt 456 threads to a valve body 457 constructed of a solid block and having a valve and suitable passages formed in it. The valve body 457 threads to the outer tubular sleeve at a set of threads 458. Oil flows around the solenoid housing 451, into the passage 459 and to a port 460. The port 460 opens into a three-position, four-way valve identified generally at 461. The valve 461 receives fluid under high pressure through the port 460 for its operation. In a center position, the valve 461 blocks flow through the port 460. The valve is equipped with a spool 462 which has a central or neutral position where no flow occurs. It has an up position and a down position which enable the two inlet lines to be connected directly and cross-connected to the two outlets. Their function will be described.

Two electrical solenoids operated by the signal supplied to the solenoid housing 451 move the spool. The spool has three positions, the illustrated position blocking flow through the valve. The up position permits flow in one operative condition, and the down position of the spool 462 directs flow to achieve an alternate result. One such valve is supplied by Fluid Power Systems of Wheeling, Ill.

Hydraulic oil is introduced through the port 460 to the spool operated valve. The apparatus includes a second hydraulic port 463 which extends downwardly to a sump 464 which will be described in detail hereinafter. Oil is delivered to and from the sump through the passage 463 and a valve means 465 in the passage 463. The valve 465 is a check valve limiting flow downwardly and permitting upward flow. This is better seen in FIG. 3. High pressure hydraulic fluid is delivered through the port 460 for valve operation. Low pressure oil is removed through the passage 463 from the sump. Both are connected to the valve 461 in the manner shown in FIG. 3. In the illustrated position of FIG. 1F, no hydraulic oil flows through the valve 461.

The three-position, four-way valve has two outlet ports. One outlet port is identified by the numeral 467. The high pressure outlet is port 467, the port which delivers hydraulic oil which causes a plug to choke mud flow to signal upstream. The plug will be explained later. The port 467 will be termed the high pressure outlet because it is the outlet and passage connected to extend the plug. When the plug extends, oil is forced through the passage 468 back to the valve 461. This will be termed the low pressure outlet and is to be contrasted with the high pressure outlet 467. The two outlets are thus appropriately identified dependent on the direction in which the plug moves. Extension is associated with the delivery of oil under high pressure through the high pressure port 467, while oil from the low pressure side is returned through the port 468. Retraction of the plug occurs on oil flow in the opposite direction under control by the valve 461.

Attention is next directed to the sump 464 defined by a tubular member 469 threaded on the exterior of the valve body 457. The tubular member 469 threads to the valve body and has the same external diameter as the tubular member 456 which is just above it. They both thread to the valve body so that the valve body enables a continuation of the cylindrical member on the interior of the mud flow annular space 410. The annular space 410 thus surrounds the two tubular members and the valve body 457. The valve body 457 is constructed with threads on its outer surface to make threaded connection with the tubular members as shown in the drawings. The sump 464 is immediately below the valve body 457. The tubular member 469 thus defines the outer wall of the sump, and the valve body 457 limits the extent of the sump. The lower extent of the sump is determined by a lubricated, circular plug 470 which defines the sump and is spaced from the valve body 457 to receive a quantity of hydraulic oil which is determined in large part by the size of the sump and the size of the system. This is a scale factor which can accommodate practically any size. The circular plug 470 has inner and outer faces which are protected with O-rings and is shaped somewhat like a doughnut. It is internally charged with lubricant at 471. A receptacle 471 for receiving lubricant is included. This receptacle is filled through a spring loaded check valve 472. The check valve 472 admits lubricant under pressure, pressure sufficient to overcome a bias spring 473. The spring 473 is quite strong, sufficiently strong that mud is not able to overcome the spring even at maximum operating mud pressures. The cavity 471 is filled with lubricant to enable it to flow through a port 473 which opens to the exterior. The exterior is immediately adjacent to and around the plug body. The port 473 thus delivers a thin coating of lubricant to a facial recess 474 on the exterior of the plug body, and a similar port delivers lubricant to a facial recess on the interior of the doughnut-shaped plug 470. The plug 470 is thus provided with lubricant of a heavy weight which enables it to seal against leakage of mud upwardly or hydraulic oil downwardly. The plug is exposed to drilling mud by a set of ports at 475 located around the mud annular space 410 and which introduce mud to the bottom side of the plug 470. The mud which is delivered to the bottom side pressurizes the plug and thereby pressurizes the hydraulic system to a minimum level. As the plug 470 moves, it moves with lubrication on both faces, thereby avoiding comingling of mud with the hydraulic oil. Moreover, variations in the quantity of oil in the sump 464 are accommodated. As mud system pressure varies, the minimum pressure experienced in the hydraulic system is the mud system pressure, and, of course, higher pressures are experienced on the high side of the hydraulic system.

In FIG. 1F, it will be observed that the passages 467 and 468 extend downwardly as individual passages. At this location, they are parallel and adjacent to one another. In the preferred embodiment, two, three or four parallel passages are formed. They are spaced at different locations around the periphery of the valve body 457. The several passages connect with a crossover arrangement at the lower end of the valve body 457. A crossover arrangement is desirable so that certain telescoping movements can be accommodated. The valve 461 and its various ports and passages are better shown in the system schematic of FIG. 3. In FIG. 1F, the various passages to the valve 461, the sump 464 and the passage 408 are obscured by two-dimensional presentation of the sectional view.

The numeral 477 identifies a crossover port which opens into the upper end of a tubular member 478. The member 478 passes through a set of seals into the valve body 457 at a centrally drilled hole. The tubular member 478 is open at the upper end, thereby permitting hydraulic oil to flow from the crossover port 477 down the interior of the tubular member 478. This is a high pressure passage for purposes to be described.

A crossover port 479 extends from the low pressure passage 468 and opens into a drilled opening 480. The drilled opening 480 is in the low pressure path. Again, it will be recalled that the low pressure path extending from the valve 461 is an alternate path to the high pressure path between the valve and the movable plug to be described. The drilled opening 480 opens into a movable or telescoping inner tube 481. The tube 481 is concentric within the larger tubular member 478. The connection of the inner tube 481 into the valve body 457 is sealed with a set of O-rings at 482. The inner tube 481 telescopes upwardly and downwardly within a range protected by the seals. It is a low pressure path in contrast with the high pressure fluid route heretofore described.

At the lower portions of FIG. 1F, a shoulder 483 limits downward movement of the plug 470. The plug 470 is limited in its upward travel by the fixed valve body 457 and in downward travel by the shoulder 483. This permits it to travel within limits, and it is prevented from moving past the mud ports 475.

Figure 1G:
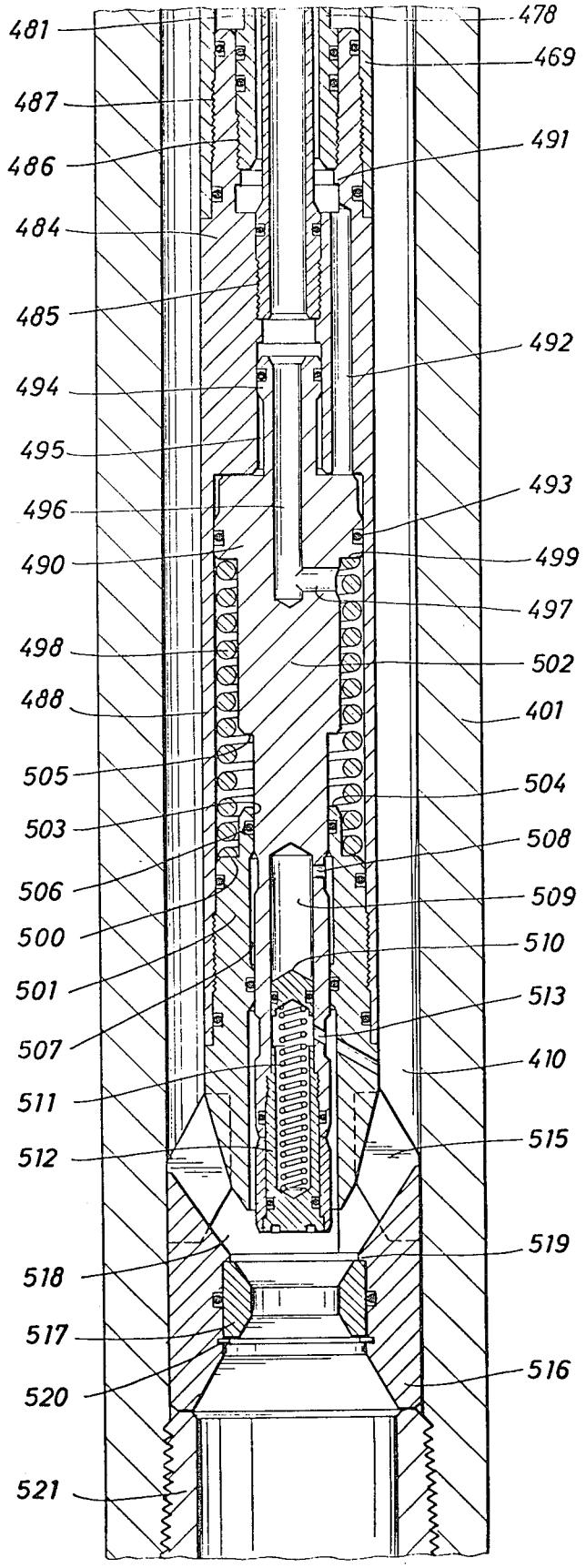

In FIG. 1G, the tubular member 469 terminates at a bottom sub 484. The bottom sub 484 threads to the larger of the three tubular member 469. They are fixed in the tool as will be described. The bottom sub 484 is constructed and arranged with an upstanding skirt threaded on the exterior and interior. The bottom sub 484 has seals adjacent to the threads to perfect the seal. The bottom sub 484 incorporates a thicker, lower portion and supports another thread at 485. The thread 485 threads to the tubular member 481. The tubular member 478 fastens to the bottom sub at a thread 486. The larger and outer tubular member connects at a thread 487.

The three tubular members shown at the top of FIG. 1G are concentric to one another. The smallest of the three provides an axial flow path which is the low pressure flow path for operation of the plug to be described. The exterior of tubular member 481 which is on the interior of the tubular member 478 defines the high pressure flow path. The next larger annular cavity is exposed to mud through the ports 475 which are just above the bottom sub 484.

The bottom sub 484 is fixed in location in a manner to be described. It has an enlarged skirt 488 which is positioned about a movable piston 490. The piston 490 is received within the skirt 488. The piston 490 has an upper face which is exposed to high pressure oil to be forced downwardly. High pressure oil flows in the annular space on the inside of the tubular member 478 and then into a circular cavity 491 in the bottom sub 484. The cavity 491 then connects with a passage 492 through the bottom sub which terminates immediately adjacent to the top or face of the piston 490. A seal ring 493 prevents leakage away from the face of the piston. The face is thus exposed to high pressure hydraulic fluid to drive the piston downwardly. The piston is slidably mounted in the bottom sub 484. The piston supports an upstanding tubular extension centrally located on the face and extending upwardly, the tubular extension being identified by the numeral 494. The tubular extension is included to provide a low pressure fluid communication path. The extension 494 is received within a mating, counterbored, centralized passage 495 for the express purpose of providing a fluid communication path. The passage has a length which enables the tubular extension 494 to reciprocate without pulling free of the passage. A seal is perfected so that the low pressure fluid path is isolated from the high pressure fluid path. The low pressure path thus extends through the tubular member 481 at the top of FIG. 1F downwardly to the terminus of that tubular member at the threaded connection 485. It continues to flow into the communicated counterbored passage 495. The tubular extension 494, being provided with a seal constructed on the exterior, enables hydraulic oil to flow into the tubular extension 494 and along a passage 496. The passage 496 terminates at a laterally extended port 497. The port 497 opens to the exterior of the piston 490 below the seal 493. The seal 493 isolates the high pressure and low pressure sides acting on the piston.

It will be appreciated that high pressure is required to force the piston down against a specified workload on the piston. When this occurs, the piston moves downwardly, and the passage 496 serves as a return route so that hydraulic oil below the piston is returned at lower pressure. When the piston is to be raised, high pressure oil is applied through the passage 496. Raising of the piston requires a smaller pressure differential inasmuch as less work is required of the piston and the connected apparatus as will be described. The piston is thus made doubleacting by this arrangement. In actuality, the doubleacting arrangement does not require equal work levels because the retraction of the piston to the raised position is against a reduced resistance.

The piston seal 493 defines the difference between the high pressure and low pressure areas. The piston is forced to the upward position by a coiled, resilient spring 498 which is a return spring which boosts the piston and thereby assists the hydraulic system on restoring the piston to the raised position. The coil spring 498 bears against the piston at a shoulder 499 which is on the bottom side of the piston and which faces a shoulder 500 therebelow, the shoulder 500 being formed on a bottom plug 501. The bottom plug 501 threads into the skirt 488, the skirt being a part of or an extension to the bottom sub 484. The skirt 488 surrounds the coil spring 498. The bottom plug, being threaded to the skirt 488, serves as a support for the coil spring 498. The coil spring 498 surrounds a piston extension rod 502 which extends significantly below the piston 498. The extension rod 502 has a reduced diameter to define an annular space where the coil spring can be located. It is reduced further in diameter so that the lower portions thereof telescope into an axial passage in the bottom plug 501. The bottom plug 501 has a passage formed in it at 503. This passage is centrally located of the bottom plug 501 and is formed in the bottom plug, terminating at an upwardly facing shoulder 504. The shoulder 504 is arranged oppositely of a coacting shoulder 505 which faces downwardly. The shoulders are spaced apart in the drawing to depict an approximate range of travel. When they abut one another, the downward stroke is limited. This is achieved at the urging of the hydraulic system, referring to the high pressure side. Retraction pulls the shoulders apart and restores them to the illustrated position when the piston is in the up position.

The fixed bottom plug 501 supports an internal seal at 506 to prevent leakage along the piston rod extension 502. Moreover, the axial passage 503 formed in the bottom plug 501 extends downwardly through the body. It is slightly enlarged at 507, the enlarged passage serving as a receptacle for lubricant. Lubricant is introduced into the passage 503 from a port 508. The port 508 communicates with an internally located lubricant storage cavity 509 which is formed in the piston extension rod 502. The lubricant storage cavity 509 is pressurized by means of a piston 510 which is located in it. The piston 510 is forced upwardly against the stored lubricant by a coil spring 511. The coil spring 511 is supported at the lower end on a threaded plug 512, the threaded plug 512 threading into an axial counterbore in the piston extension rod 502. The threaded counterbore is utilized to drill out the cavity 509 in forming the cavity, and, upon provision of a set of threads, the threaded plug can be received beneath the spring 511 and anchored in position. The coil spring 511 rests on the bottom side of the plug 510 and forces it upwardly.

System pressure for the lubricant is equal to or greater than the mud pressure which occurs in the tool. To this end, a port 513 exposes the bottom side of the piston 510 to mud pressure. The piston 510 is thus forced upwardly by the mud pressure and the force of the spring 511.

The piston extension rod 502 is free to reciprocate downwardly from the illustrated position of the drawings, and, on so doing, it extends the threaded plug 512. The numeral 514 identifies an armor jacket which is attached to the threaded plug 512 and surrounds the outer face of it. It is locked to it on threaded assembly of the plug to the piston extension rod 502. It is locked on by a step shoulder at the lower end. The threaded plug 512 includes a pair of openings for a spanner wrench for attachment and removal. The jacket 514 is made of extremely tough material which is resistant to the abrasive nature of drilling mud which flows through the system.

Attention is directed to the annular mud flow space 410 which is on the exterior of the bottom plug 501. The flow space 410 extends downwardly past the bottom plug and is on the annular exterior, providing a flow path for handling a specified volume of mud. At this juncture, it will be observed that the bottom plug 501 is centrally supported by means of radially extending support vanes 515. There are three or four support vanes which connect from the fixed bottom plug 501 and which join to a ring 516. The ring 516 functions as a restriction ring which reshapes the mud flow path at this point. The mud flow path is altered from an annular flow path at the vanes 515, where it is directed to the interior of the apparatus, namely, axially through a passage in the restricter ring 516. The restricter ring has a seat 517 placed in it which is formed of hardened and resistant material. The seat 517 is shaped and profiled to funnel the mud through the seat. The seat is supported on the ring 516. The ring has a funnel-shaped shoulder 518 which directs the mud flow past the vanes 515 and toward the seat. It will be observed that the vanes 515 are supported in slots which are cut into the restricter ring 516. The restricter ring supports the seat 517 in position, there being an overhanging shoulder 519 to lock the seat in position, the seat being held in position through the use of a snap ring 520. The snap ring thus fastens the removable seat in location.

It will be recalled that the jacket 514 is made of a tougher material. The same is also true of the seat 517. When the piston 490 is extended downwardly, the piston extension rod pushes the jacketed lower tip 514 into the restricter ring immediately adjacent to the removable, hardened seat to constrict mud flow. The extent of restriction is a scale factor. The extent of restriction is sufficient that a flow blockage is created, thereby forming a pressure wave which is sensed at the surface in the column of drilling mud. The stroke of the piston carries the jacketed lower tip 514 into the restricter ring so that mud flow is almost closed. It is not necessary to close the path completely. It is helpful to restrict it significantly, and, to this end, the jacketed tip is sized so that there is some gap around it where mud can flow past it; nevertheless, the mud flow path is notably restricted to form a pressure pulse sensed at the surface. The restricter ring 516 is held in position by a threaded sub 521 which locks it in place. The threaded sub 521 is used to position and anchor the ring in position.

Extension of the piston 490 is accomplished in response to high pressure hydraulic oil which is delivered from the valve located higher in the tool. When extension occurs, the piston rod extension 502 is guided along the desired path to restrict flow of drilling mud. When it is retracted, the movement creates a pressure surge change which is reflected up the column of mud. Both movements (extension and retraction), therefore, form signals which can be sensed at the surface.

Operation of the present apparatus should be considered. As a beginning point, the measuring while drilling tool 400 is placed in a drill string near the drill bit among the other drill collars. It is equipped with a set of sensors which form electrical output signals. For sake of discussion, assume that the output sensors provide a measure of the angle of inclination of the tool referenced to true vertical. Assume that the signal of interest requires closure of the plug for 4.0 seconds. A suitable solenoid operation signal is formed for operation of the solenoid valve for 4.0 seconds.

Going to the top end of the tool, the pressure of the mud in the drill string forces the nose plug 402 downwardly slowly at a rate dependent on oil flow in the hydraulic system. Hydraulic oil in the annular cavity 408 is pressurized. It has a long and somewhat circuitous flow path through the tool, but this path delivers high pressure oil to the valve 461. High pressure oil is introduced to the central part of the spool of the valve 461. The valve is connected to two outputs. One is labeled the high pressure output side at the passage 467, while the low pressure output passage is identified at 468. When the valve operates, both flow paths are completed so that high pressure oil from the top end of the tool flows through the valve 461 and down to the bottom end of the tool for operation. In like manner, operation of the valve completes a flow path for low pressure oil from the passage 468 to flow through the valve 461 and eventually to the sump 464. For the operation of the valve, the solenoid in the housing 451 moves the spool for the requisite interval. Movement of the spool communicates the high pressure oil to the designated route, and the flow of oil is thereafter noted at the lower parts of the tool.

When oil is delivered under high pressure above the piston 490, the piston is forced downwardly, thereby interdicting flow of mud through the restricter ring 516. The restricter ring 516, in cooperation with the jacketed tip affixed to the piston 490, restricts the mud flow and forms a signal pulse beginning on insertion of the jacketed tip and ending on restriction. These two signals are transferred up the drill string to the surface.

Retraction is achieved after the solenoid operated valve 461 is operated for retraction. When it operates, it moves to a position so that the oil on the top side of the piston is permitted to flow back through the passage 467 and through the valve 461. It is restored to the sump 464. The high pressure side of the apparatus is charged with oil as required. It will be kept in mind that the nose plug 402 is exposed to pressure variations in mud flow and moves downwardly to pressurize the oil to complete the signal. Full range travel is assured by the construction of the upper end of the tool whereby restricter rings 412 and 413 cooperate with the thick external sleeve 409 to assure that the upper end of the tool travels a specified distance to pump a requisite quantity of oil.

When the mud pumps are switched off, the top end of the tool is forced upwardly by the coil spring 435. The spring 435 is compressed when the nose plug is forced downwardly. The movable plug 402 pressurizes the oil on the downstroke and refills the hydraulic system pressure on the upstroke to recover oil from the sump. Upward movement is associated with charging, and the length of stroke assures that an adequate quantity is charged to the high pressure side.

Figure 2:
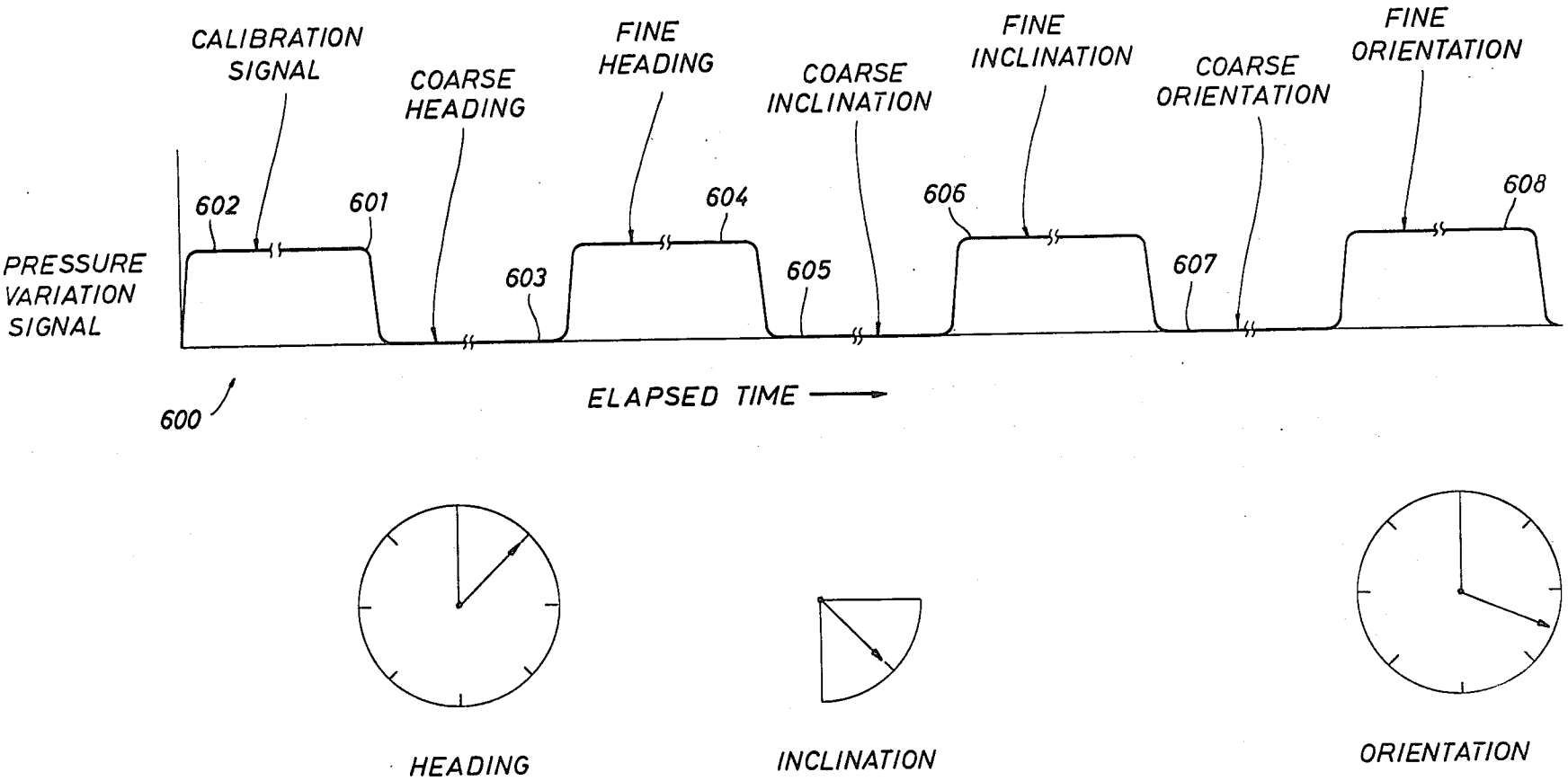
FIG. 2 is a pressure variation versus time chart showing a method of encoding downhole variables in pressure variations and further including definitions of certain variables.

Attention is directed to FIG. 2 of the drawings which shows a chart or graph of the pressure variation signal identified generally by the numeral 600. The chart or graph 600 shows grouping of the signals. The ordinant is pressure variation signal. For instance, this can readily be the control signal applied to the solenoid operated valve. In actuality, that signal is relatively sharp, having a fast rise and fall time. The chart or graph of FIG. 2 shows degraded rise and fall time in the signal. Thus, the signal waveform at 601 is slightly rounded as will occur at the well head on reading the transmitted pressure pulse signal.

The solenoid controlled valve 461 is operated to form signals which are characterized by changed constriction of the mud flow. FIG. 2 thus shows a pressure variation signal. For instance, the mud flow is highly constricted to form a calibration signal 602. The signal 602 has a finite length in accordance with the predetermined calibration requirement.

The first variable transmitted is heading. Heading references north as zero degrees, and the heading of the tool is some angle between zero and 360.0 degrees. The measurement is broken down into a coarse portion and a fine portion. The coarse heading is transmitted at the pressure variation 603 shown in the waveform 600 to be a reduced signal. By contrast, the fine component of the heading is identified at 604 and represents the fine value of the heading. Referring for the moment to the compass rose found in FIG. 2, the heading can be any value between zero and 360.0 degrees. The heading is preferably broken down into equal large segments as, for instance, sixteen segments of 22.5 degrees each. The segments are encoded in the coarse heading signal 603. If, for instance, the actual heading includes eleven coarse segments, this signal is encoded by operating the solenoid valve for the duration necessary to represent the arbitrary coarse heading signal multiplied by eleven. If each segment is represented by closure of the valve by 4.0 seconds, then the coarse heading signal is 44.0 seconds long in this example. Ordinarily, it is not necessary to utilize a scale factor this large. Each segment can be represented by a signal in the area of 1.0 second or so. Thus, the coarse heading in that instance might be encoded by a signal waveform 603 which is 11.0 seconds long. The fine heading represents the fractional component of the heading. If, for instance, the actual heading is 30.0 degrees, this encodes as one coarse increment with 7.5 degrees remaining to be encoded as a fine heading. If the scale value chosen is 2.0 degrees per second, the fine heading signal 604 has a duration of slightly under 4.0 seconds.

The coarse and fine heading values can be varied to alter the scale factor. One scale factor is a specified number of seconds for the coarse variable and a specified number of seconds for the fine variable. Needless to say, decoding utilizes knowledge of the scale factor to reconstruct the heading.

The waveforms 602 and 604 have an excursion in one direction, while the waveform 603 represents an excursion in the opposite direction for purposes of contrast.

Another variable such as inclination is also decoded. As an example, inclination can be a maximum value of 90.0 degrees with the value broken down into coarse increments of 10.0 degrees and fine increments of 1.0 degree. To this end, the waveforms 605 and 606 represent the inclination broken into two representations. In like manner, orientation is encoded in two components, namely, coarse and fine. The waveforms 607 and 608 are encoded to represent orientation.

From the foregoing, it will be understood how the three variables of interest are encoded. Other variables can also be encoded. In particular, the pressure variation signal sensed at the surface may have a waveform which resembles that shown in FIG. 2. This is decoded by specifying a pressure excursion to represent the minimum and maximum values as, for instance, the ten percent (10.0%) and ninety percent (90.0%) values. This permits some overshoot and undershoot. Once the calibration signal is received and the duration of it is measured for the ninety percent value, this can be used as a scale factor to convert all the other variables into decoded form.

Figure 3:
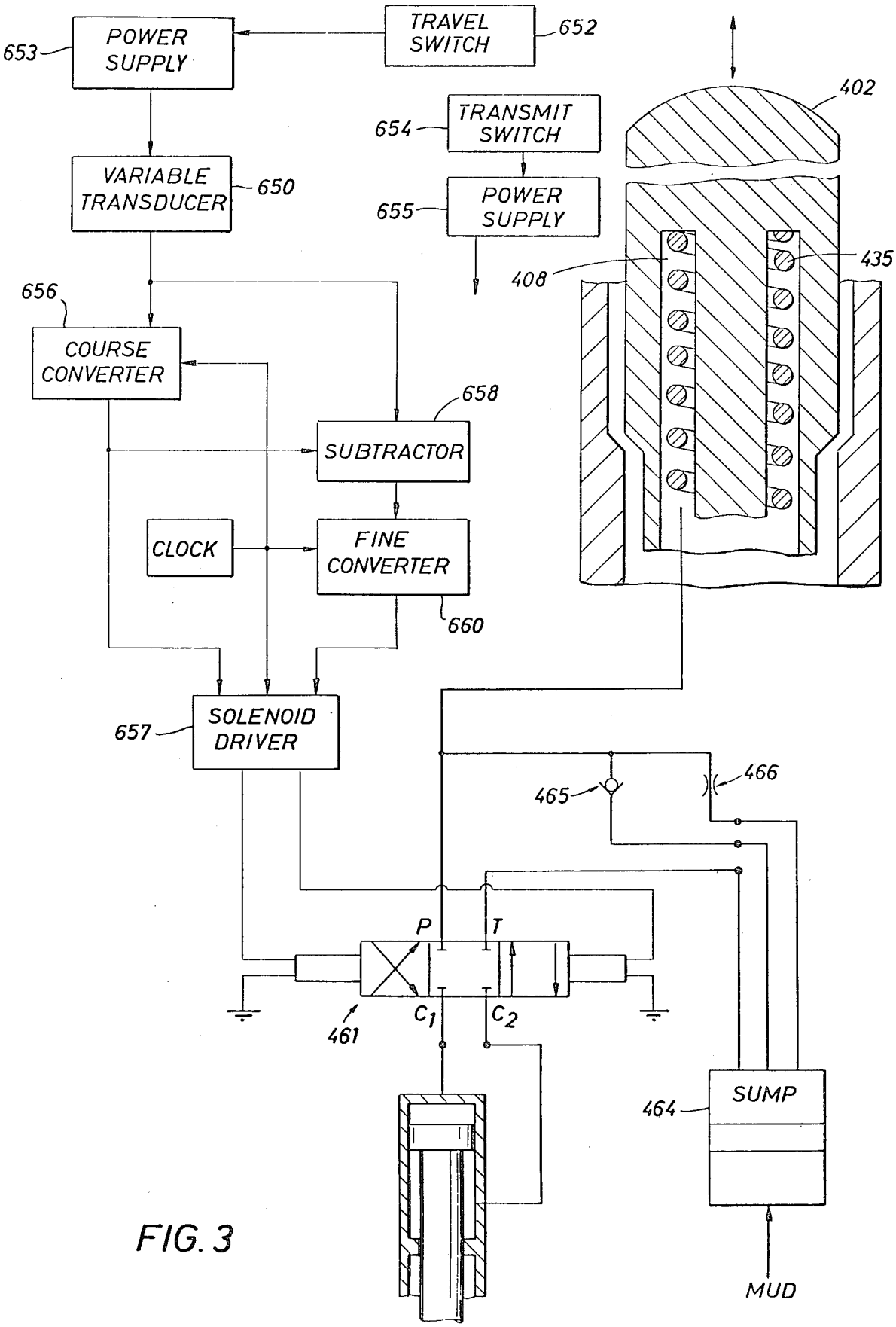
FIG. 3 is a simplified hydraulic schematic of the apparatus shown in the present disclosure.

To obtain the signals shown in FIG. 2, suitable transducers 650 are shown in FIG. 3. One such transducer is represented, although it will be appreciated that more than one can be used. The variable transducer measures some parameter of interest such as heading, inclination, orientation, temperature and the like. This variable is converted into an output signal having some suitable scale factor. The variable transducer 650 forms an output signal when it is enabled. It is enabled for operation by providing power for its operation. To this end, a travel switch 652 is located in the top end of the tool where the nose plug 402 travels. The nose plug 402 rises to its highest extremity of travel and thereby trips the travel switch 652. The travel switch enables a timed power supply 653 which powers the variable transducer for a specified time. The nose plug must travel downwardly past a transmit switch 654. The transmit switch responds to movement of the nose plug 402 to thereby form a signal enabling a second power supply 655. This power supply is connected to the remainder of the circuitry shown in FIG. 3.

The power supply 655 enables operation of the equipment connected to process the output signal of the transducer 650. The transducer 650 is thus turned on only after the nose plug 402 rises to its maximum range of travel. This most often occurs on interrupted drilling. During drilling, the equipment is in the passive or "off" state. When drilling is interrupted, the nose plug 402 is forced upwardly by the coil spring 435. The coil spring 435 is shown in FIG. 3 where the view has been simplified somewhat, the spring 435 being illustrated just below the plug 402. This simplification has been made for the sake of clarity to show how the coil spring forces the nose plug up to arm the tool. It moves up when mud pressure drops. It starts down when the pump is restarted and drilling is initiated again. After restarting the mud pump to increase the mud pump pressure, the nose plug 402 is forced downwardly and trips the transmit switch 654. It provides power for other equipment to be described.

The variable transducer 650 forms an output signal supplied to a coarse convertor 656 which forms an output signal supplied to a solenoid driver 657. That, in turn, is connected to the solenoids within the solenoid housing 451 for operation of the valve 461. The valve is preferably a three-position valve. The illustrated or center position is off. It is driven to either extreme by momentary solenoid operation. It is restored to the center position by operation of a centralizing spring.

Ideally, two solenoids are incorporated, each connected to respond to a driving signal. The coarse convertor converts the data into a coarse measurement as, for instance, measuring the number of large or coarse increments in the variable. The solenoid driver is driven for this requisite interval. If the scale factor is 2.0 seconds per increment and the coarse measure determines that three increments are present, the solenoid driver momentarily moves the valve spool to move the plug for 6.0 seconds after which time the plug is pulled up by reversing the valve momentarily. The coarse convertor forms two outputs. One is provided to a subtractor 658. The subtractor is furnished with a variable from the transducer 650 and forms an output which represents that part of the variable measured which has not been represented by the coarse signal. Consider as an example that the inclination measures 20.0 degrees and further that the coarse component is 15.0 degrees. For a 20.0-degree inclination, one coarse increment leaves 5.0 degrees of fine variation, and this fine variation is encoded in the form of 5.0 degrees by a suitable scale factor. This also forms an output signal supplied from the fine convertor 660 to the solenoid driver 657. Operation is timed by a clock.

In operation, as long as mud pressure persists as occurs during routine drilling operations, the nose plug 402 is down, and nothing transpires. When drilling is interrupted, the spring 435 forces the nose plug 402 up. As it moves up, the oil system in the top end of the tool is charged through the check valve. Some charging occurs through the constricted orifice, but it is relatively small. Charging occurs by drawing hydraulic oil from a sump 464 previously mentioned. The mud pressure in the drill string remains sufficient to slightly pressurize the sump 464. As oil rises, it fills the top end of the tool beneath the nose plug 402, particularly the annular cavity 408.

When drilling commences again, the increase of pressure in the drill string forces the nose plug 402 down very slowly. As pressure is applied to it, it raises the pressure in the oil system. The increase in oil pressure makes high pressure oil available to the solenoid valve 461. In FIG. 3, it is shown in the closed position. it is switched between closed and open positions to vary the position of the constricter shown in FIG. 3. This transmits the signals. Each time the solenoid valve 461 is operated to either open position, a certain portion of oil flows from under the nose plug 402, and it falls further in the tool. This continues until all the signals have been transmitted. To be sure that an adequate supply of oil is made available, an excess is accumulated under the nose plug 402 compared with that required to operate to transmit even the maximum values of the signals. It will be understood that large signals require more time and, hence, more hydraulic oil to transmit. Any excess oil which remains under the nose plug 402 is eventually forced out through the orifice into the sump 464. The sump is thus expanded as the oil is returned to it. Oil is returned to the sump from only two sources, namely, through operation of the valve 461 or eventual bleed-off of the chamber 408 beneath the nose plug 402 via the illustrated orifice.

From the foregoing, it will be understood how the solenoid valve 461 is connected to open and close the constricter to form pressure variation signals in the mud flow and how the hydraulic oil is primarily returned to the sump 464.

While the foregoing is directed to the preferred embodiment of the present invention, other and further embodiments of the invention may be devised without departing from the basic concept thereof, and the scope thereof is determined by the claims which follow.

I claim:

1. A method of transferring data from a tool having a measuring sensor with the tool connected in a drill string wherein mud flows along the drill string under urging of a mud pump connected to the drill string wherein the method comprises the steps of:

(a) taking a measurement of a variable of interest with a downhole measuring sensor;

(b) converting the measurement into a measurement given by the relationship $$x=am+bn$$

where x=the measured variable;
m=large unit of measure of the variable;
n=small unit of measure of the variable;
a=an integer between o and j;
b=an integer between o and k;
bn(b=k)=am (a=1); and
am (a=j) is the maximum variable measurement;

(c) forming a restriction to mud flow in the drill string wherein the restriction alters mud pressure between higher and lower levels at the well head; and (d) altering the restriction to encode the measured variable as time dependent functions of a and b wherein the functions a and b are separately encoded in sequence and separated by a pressure change between higher and lower pressures observed at the well head.

2. The method of claim 1 wherein the a and b functions are serially formed and wherein one is represented by an increased mud flow restriction and the other is represented by a reduced mud flow restriction.

3. The method of claim 2 wherein the mud flow restrictions are varied at the ends of the a and b functions.

4. The method of claim 3 wherein the mud flow restrictions are varied sequentially for a and b functions of a first variable and where a second variable is thereafter encoded into a and b functions therefor.

5. The method of claim 1 wherein the variable is drill collar orientation.

6. The method of claim 1 wherein the variable is well bore heading.

7. The method of claim 1 wherein the variable is well bore inclination.

8. The method of claim 4 including the step of transmitting a calibration pulse of specified length in the form of a mud pressure pulse.

9. The method of claim 3 including the step of transmitting in sequence:

(a) a calibration pulse;
(b) a first variable a function;
(c) a first variable b function;
(d) similar a and b functions for additional variables; and
(e) wherein consecutive pulses are alternately relatively high and low pressure levels.

10. The method of claim 1 including the steps of measuring two variables of interest, forming a and b functions for both measurements and sequentially encoding all of the functions is a specified order having four pressure pulses separated by three pressure levels changes.

11. The method of claim 3 wherein the large measurements are encoded prior to encoding the small measurements.

12. The method of claim 3 wherein the range of the variable of interest is divided into a set of j equal large units of measure and each large unit measure is divided into k equal subportions, and a and b are integers representing the number of large and small units of measure.

13. The method of claim 3 wherein the step of restricting mud flow includes extending a mud flow plug.

* * * * *